United States Patent [19]

Flesher et al.

[11] Patent Number: 4,726,572

[45] Date of Patent: Feb. 23, 1988

[54] SPRING COIL AND SPRING ASSEMBLY

[75] Inventors: Keith A. Flesher, Ronsselaer, Ind.; Robert F. Wagner, Lombard, Ill.

[73] Assignee: Sealy, Incorporated, Chicago, Ill.

[21] Appl. No.: 864,090

[22] Filed: May 16, 1986

[51] Int. Cl.[4] ..... F16F 3/04; B21F 27/00; A47C 23/02

[52] U.S. Cl. ..... 267/91; 5/248; 5/256; 140/3 CA; 267/93; 267/103

[58] Field of Search ..... 267/91, 93, 97, 101, 267/103, 105; 5/256, 257, 248, 269, 474, 475, 249; 140/3 CA; 29/173

[56] References Cited

U.S. PATENT DOCUMENTS

| | | | |
|---|---|---|---|
| 188,636 | 3/1877 | Holmes | 5/264 B |
| 1,337,320 | 4/1920 | Karr | 5/269 |
| 1,804,821 | 5/1931 | Stackhouse | 5/269 X |
| 1,839,325 | 1/1932 | Marquardt | 5/256 X |
| 1,887,058 | 11/1932 | Karr | 5/269 |
| 1,938,489 | 12/1933 | Karr | 5/269 |
| 2,029,076 | 1/1936 | Leeman | 5/269 X |
| 2,052,325 | 8/1936 | Travis | 5/269 |
| 2,137,298 | 11/1938 | McCoy | 5/269 |
| 2,254,106 | 8/1941 | Krakauer | 5/269 |
| 2,265,426 | 12/1941 | Foster | 5/269 |
| 2,516,566 | 7/1950 | Hager | 5/269 |
| 2,581,686 | 1/1952 | McRoskey | 5/269 |
| 2,849,057 | 8/1958 | Neely | 267/107 |
| 3,089,154 | 5/1963 | Boyles | 267/93 |
| 3,533,114 | 10/1970 | Karpen | 5/475 |
| 3,653,082 | 4/1972 | Davis | 5/269 |
| 4,092,749 | 6/1978 | Klancnik | 5/267 |
| 4,535,978 | 8/1985 | Wagner | 5/256 |
| 4,609,186 | 9/1986 | Thoenen | 267/103 |

FOREIGN PATENT DOCUMENTS

| | | | |
|---|---|---|---|
| 0386251 | 1/1933 | United Kingdom | 5/269 |

*Primary Examiner*—Andres Kashnikow
*Assistant Examiner*—Robert J. Oberleitner
*Attorney, Agent, or Firm*—Willian Brinks Olds Hofer Gilson & Lione Ltd.

[57] ABSTRACT

A spring coil has an open-ended terminal convolution which is connected to the body of the coil through a gradient arm. The gradient arm can be readily varied in length in manufacture to alter the compression and thereby the firmness of the spring coil. Offset portions are advantageously formed on terminal convolutions with a major straight part which is outwardly spaced from minor straight parts. This provides a three point engagement for the offset portion when connected to a border wire with a border wire helical spring. The offset portions of the spring coils have inside and outside shoulders adjacent their ends. The pitch of cross-helicals which join overlapped offset portions is chosen so that a cross-helical simultaneously engages the outside shoulders of one of a pair of overlapped offset portions to firmly hold the spring coil against rotation. The cross-helical preferably also catches the inside shoulders of the other overlapped portion to additionally hold that spring coil against rotation.

21 Claims, 15 Drawing Figures

SPRING COIL AND SPRING ASSEMBLY

BACKGROUND OF THE INVENTION

Mattress innerspring units are generally formed of a plurality of spring coils arranged in side-by-side relation in parallel rows, with parallel columns also thereby being formed orthogonal to the rows. Border wires typically encircle both the upper and lower perimeters of the innerspring unit formed by the most outboard spring coils and are connected to terminal convolutions formed on the ends of the spring coils.

It is a common practice to form the terminal convolution with an enlarged diameter with respect to that of the spirals which are axially inward from the coil ends. This facilitates interengagement of the springs and makes the spring coil more stable in compression. Terminal convolutions of adjacent spring coils in a row are overlapped, and helical spring coils, referred to as cross-helicals, are then wound along columns to encircle the overlapped convolution portions. These cross-helicals ordinarily have an internal diameter which is slightly larger than the combined diameters of the overlapped terminal convolution portions. Larger diameter helical springs are also often used to attach a border wire to the terminal convolutions.

There are some general considerations of manufacture and comfort which underlie the design of any mattress innerspring. For example, considerable effort has been devoted in the industry to the development of terminal convolutions which facilitate the interengagement of the spring coils as well as their connection to the border wire. For example, terminal convolutions have been developed having offset portions formed thereon which include a straight part. This enables the spring ends to be secured along a substantial length of the straight part which will "catch" more helical spirals, and thereby provide more stability for the individual coils. Improved stability is always being sought, however.

These efforts have also been directed to find ways to prevent the spring coils from rotating relative to each other, and perhaps out of the upper or lower plane of the unit. A related problem in this area is that of hinging, where the overlapped portions of coils slip over one another and make noise. Hinging can further occur between coils overlapped with the border wire. Such hinging is obviously desired to be kept at a minimum in a mattress.

Another consideration in mattress design and manufacture is the ability to make innerspring units which have different firmness characteristics suited to an individual's personal preference. This may simply amount to providing several mattress lines having differing firmness, or, in more sophisticated mattresses, providing areas of different firmness in a particular mattress innerspring.

As may be readily recognized, producing mattresses with different firmness characteristics may be accomplished through the use of springs of differing compression for each mattress firmness, ordinarily achieved by making the various springs out of different wire stock or in different configurations. The overall layout or construction of the innerspring unit may also be changed from one mattress firmness to another, such as by changing the coil count and coil arrangement. Use of heavier wire stock, more springs, different springs or a different layout obviously adds expense to mattress production in terms of parts as well as labor. A primary consideration in making mattresses with different degrees of firmness is therefore to do so in the most efficient and economical manner while still achieving the desired results.

FIELD OF THE INVENTION

This invention relates to spring coils and spring coil assemblies, and particularly to those used in mattress innersprings.

SUMMARY OF THE INVENTION

The present invention provides a number of innovations and improvements to spring coils and spring coil assemblies, particularly as adapted for use in a mattress innerspring unit. The general considerations outlined above take form in the present invention as a spring coil having a firmness that is readily adjusted in manufacture. The invention further includes spring coil and spring assembly features that assure that the spring coils have little or no rotation relative to each other or to a border wire surrounding an innerspring unit. The invention also comprises various arrangements of spring coils and cross-helicals that yield innerspring assemblies of different firmness characteristics.

In one aspect of the invention, a spring coil has a spiral coil body and a pair of terminal convolutions. At least one of the terminal convolutions has a C-shaped configuration, which in a present embodiment is comprised of first and second opposed offset portions joined together at one end by a third offset portion. The remaining portion of the terminal convolution is open. All of the offset portions generally lie in the same plane.

The first offset portion has a free end. The second offset portion joins with the spiral coil body via a connecting segment in the form of a gradient arm which extends in the same plane as the terminal convolution. The gradient arm is adjustable in length in manufacture to vary the compression and thereby the firmness of the spring coil. A single basic configuration for the spring coil using a single wire stock can thus be employed to make innerspring units of differing firmness characteristics.

Another aspect of the invention is forming the terminal convolution with one or more offset portions that provide a three point engagement with a border wire when attached thereto with a border wire helical. The offset portion has a stepped segment formed thereon comprised of a major part that is substantially straight and spaced radially outwardly from the spring coil axis, an angled part extending away from the major part at each end of the major part, and minor straight parts which are substantially in line with each other and parallel to the major straight part and extend outwardly from the angled parts. The stepped offset portion of perimeter spring coils is overlapped with a border wire and a border wire helical then coiled around the major and minor straight parts to hold the offset portion against rotation about the border wire.

Yet another aspect of the invention contemplates forming the terminal convolution with offset portions terminating in shoulders. The offset portions of adjacent coils in a row are overlapped, with the overlapped portions then encircled with a cross-helical having an internal diameter which is slightly greater than the combined diameters of the overlapped portions. The helical pitch is matched to the distance between the outsides of the shoulders of at least one of the overlapped offset portions such that the cross-helical simultaneously engages the shoulder outsides. The spring coil having its terminal convolution so captured is thereby prevented from rotating. This form of the invention is advantageously further adapted so that the cross-helical also simultaneously engages the inside shoulders of the other of the overlapped offset portions in each pair as additional fixation against rotation of the other spring coil.

Still another aspect of the invention resides in unique arrangements of spring coil rows and the use of cross-helicals to interengage the coils. In this respect, the innerspring unit has a length and a width, with the length being longer than the width. The spring coils are arranged in rows extending across the width, with the spring coil columns thereby formed extending along the length. The cross-helicals joining adjacent overlapped spring coils in a row thus extend along the columns. It will be noted that the arrangement of rows across the width of the innerspring unit permits rows to be spaced closer together in certain areas of the unit for more firmness. These areas of increased firmness would accordingly be constant across the entire width of the mattress.

A second set of cross-helical springs is then provided which extend along the rows and are coiled about terminal convolution portions other than the overlapped portions. Additional firmness is thus provided for the mattress. This additional firmness from the orthogonally arranged cross-helicals can be concentrated in specific areas of the innerspring unit, such as the middle third for example, or can extend for the entire length. Provision of the principal set of cross-helicals along the length of the mattress makes such selective "posturizing" easily accomplished.

A variant on the foregoing use of orthogonal cross-helicals is the formation of a spring assembly with the rows overlapped, such that offset portions of the springs in one row extend into the terminal convolutions of an adjacent row. The second set of cross-helicals (across the width) are then coiled about the overlapped portions of the terminal convolutions of the spring coils in adjacent rows.

It will be noted that a presently preferred form of the invention utilizes a spring coil configuration having an open end offset shape for the terminal convolution. Three offset portions are provided, two of which are generally segments which are parallel to each other on opposite sides of the coil body. The third offset portion joins the other two, and is provided with the stepped offset segment set forth above for three point border wire engagement. It will thus be understood that the various aspects or features of the invention can be used alone or in combination, as may be desired.

The foregoing features and advantages of the invention will be further understood upon consideration of the following detailed description of various embodiments of the invention taken in conjunction with the accompanying drawings, in which:

DETAILED DESCRIPTION OF PRESENTLY PREFERRED EMBODIMENTS OF THE INVENTION

While the invention has found particular application for the innerspring unit of a mattress, and is so described in this environment hereafter, it will be understood that the invention is not limited to this application alone but may find utility in other employments.

Figure 1:
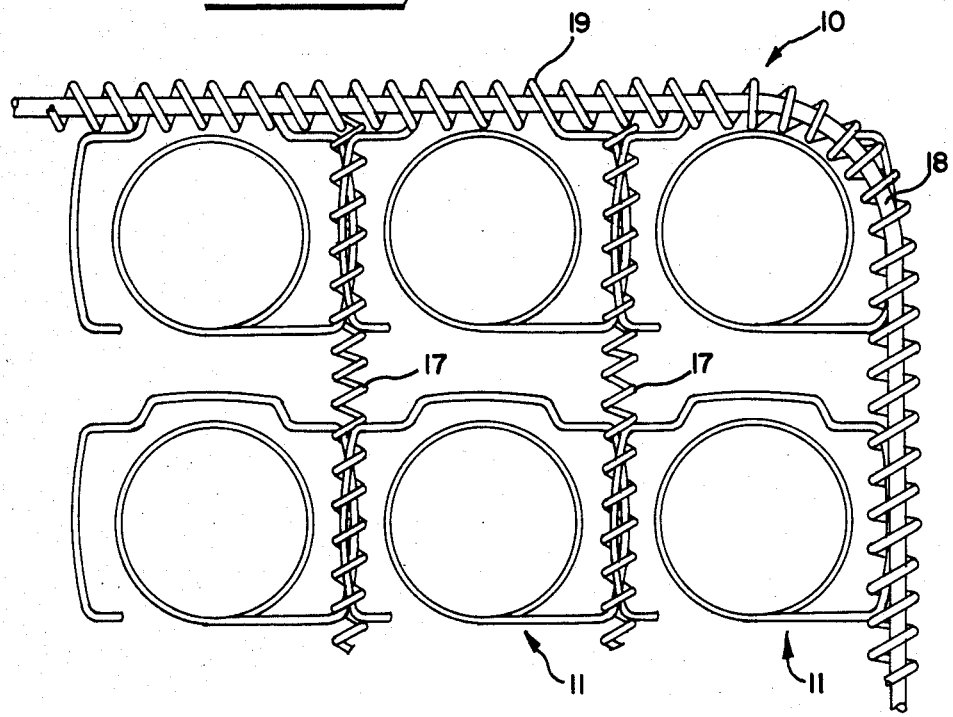
FIG. 1 is a plan view of an end portion of a mattress innerspring unit incorporating the spring coil of FIG. 2.

Referring now to the drawings, FIG. 1 shows an innerspring unit or assembly 10 comprised of spring coils 11 arranged in a rectangular pattern of parallel rows. The rows are shown here extending from right to left as viewed in this drawing, with adjacent rows being spaced apart. These rows extend across the width of the innerspring unit 10. Columns of spring coils 11 (simply referred to as coils hereafter) are thereby formed which extend along the length (longitudinally) of the innerspring unit 10 and are orthogonal to the rows.

Extending the rows across the width of the unit permits making areas of increased firmness by simply moving rows closer together. The areas of increased firmness are thereby constant across the width of the unit.

Figure 2:
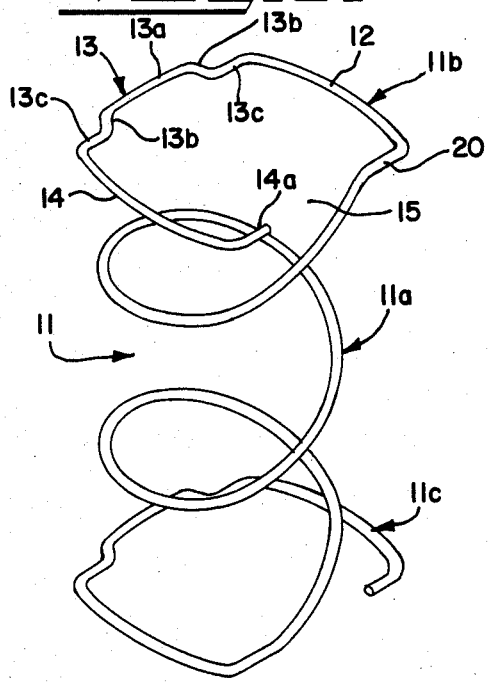
FIG. 2 is a perspective view of a spring coil embodying the gradient arm of this invention.

With reference now to FIG. 2, the coil 11 has a spiral coil body 11a with terminal convolutions 11*b* and 11*c* formed at each end. The spiral body 11*a* of the illustrated coil has a fairly constant diameter of about 1.843 in. in this embodiment. The terminal convolutions 11*b*, 11*c* are identical in form, and have a larger diameter than the spiral body 11*a*. The coil has an overall axial length of about 5.00 in. in this embodiment.

The terminal convolutions 11*b*, 11*c* are each formed in an open end offset configuration comprised of three offset portions 12, 13 and 14 and an open end 15. The overall shape for the terminal convolution 11*b*, 11*c* is seen to be rectangular. The offset portions 12 and 14 have generally straight segments which are roughly parallel to each other and of approximately the same length. The third offset portion 13 extends between ends of the first and second offset portions 12, 14 and has a stepped segment which will be described in more detail hereafter. All portions of the terminal convolution are approximately in the same plane, which is perpendicular to the axis of the spring coil. These coils 11 are made from a single piece of wire stock, such as 15 gauge (0.072) wire, which is first given a spiral body shape and then provided with the desired terminal convolutions.

The coils 11 are positioned so that the offset portions 12 and 14 of adjacent coils in a row overlap. The overlapped offset pairs are then secured together by spirally rotating a first set of helical coil springs 17 across the rows, i.e. along the columns, so as to interlace the overlapped offset portions. The cross-helicals 17 have an internal diameter which is just slightly greater than the diameter of the overlapped offset portions so that the overlapped relationship is maintained in use. The terminal convolutions 11*b* and 11*c* on both the upper and lower sides of the innerspring unit 10 are thus laced together in this fashion. Providing such long relatively straight segments to the offset portions 12 and 14 enables a significant number of cross-helical turns to be made thereabout, which yields a secure engagement of overlapped offset pairs and greater stability for the coils 11.

Offset portions 12–14 at the perimeter of the innerspring unit 10 are attached to a border wire 18 that extends around this perimeter. A border wire helical spring 19 is used to make this attachment and is spirally wound about the offset portions which are overlapped with the border wire. A border wire 18 is provided for both the upper and lower sides of the innerspring unit.

Second offset portion 14 has a free end 14*a* which is inwardly turned to extend generally perpendicularly to the straight segment of the second offset portion. First offset portion 12 extends into a connecting segment 20 which connects the terminal convolutions 11*b*, 11*c* to the spiral body 11*a* at a shoulder. The integral connection of the connecting segment 20 and the spiral body 11*a* is at an angle, i.e. not a smooth transition. This connecting segment 20 extends generally perpendicularly from the end of offset portion 12, and is in the same plane as the terminal convolution.

Figure 8:
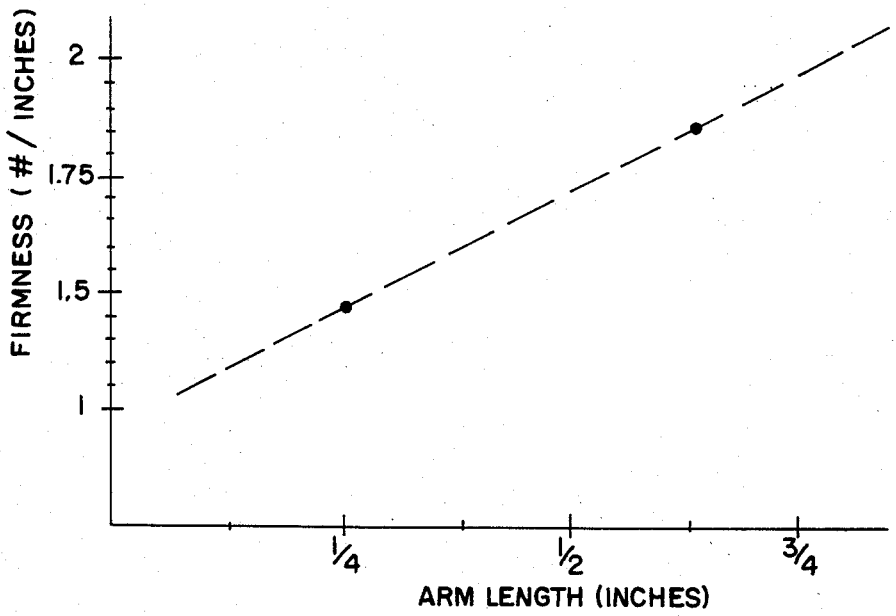
FIG. 8 is a graph of spring compression related to the length of the gradient arm.

The connecting segment 20 forms what will be referred to as a gradient arm for the coil 11. FIGS. 10*a* and 10*b*, 11*a* and 11*b* and 12*a* and 12*b* illustrate three terminal convolutions with different gradient arm 20 lengths. The compression of the coil 11, and thus the firmness of the coil, can be adjusted within limits by varying the length of this gradient arm 20. This will be seen with reference to the graph of FIG. 8.

As shown in this graph, a coil having a gradient arm of about ¼ in. in length (measured from the end of the straight segment of the first offset portion 12 to the bend into the spiral body) had a spring gradient of 1.45 lbs./in. A like coil 11 with a gradient arm of ⅜ in. in length had a spring gradient of 1.85 lbs./in.

From the foregoing it will thus be seen that the compression or firmness of the individual coils can be varied by adjusting the length of the gradient arm 20. This is readily accomplished in manufacture through a relatively uncomplicated adjustment in the coil forming machinery. Spring coils of varying firmness can therefore now be manufactured on the same machine from the same wire stock in an efficient and cost effective manner.

A present estimate places the preferred range for the length of the gradient arm 20 at about 3 to 9% of the active material length of the spring coil. The active material length is considered to be that length of material which is free to deflect when a load is applied to the spring. The spiral portion of the coil, exclusive of the gradient arms and terminal convolutions, would thus constitute the active material length for the coils illustrated herein.

Also, while this firmness adjustment feature of the invention has been described in relation to an embodiment having particular offset portions, it is considered to have applications to other terminal convolution configurations.

Figure 9:
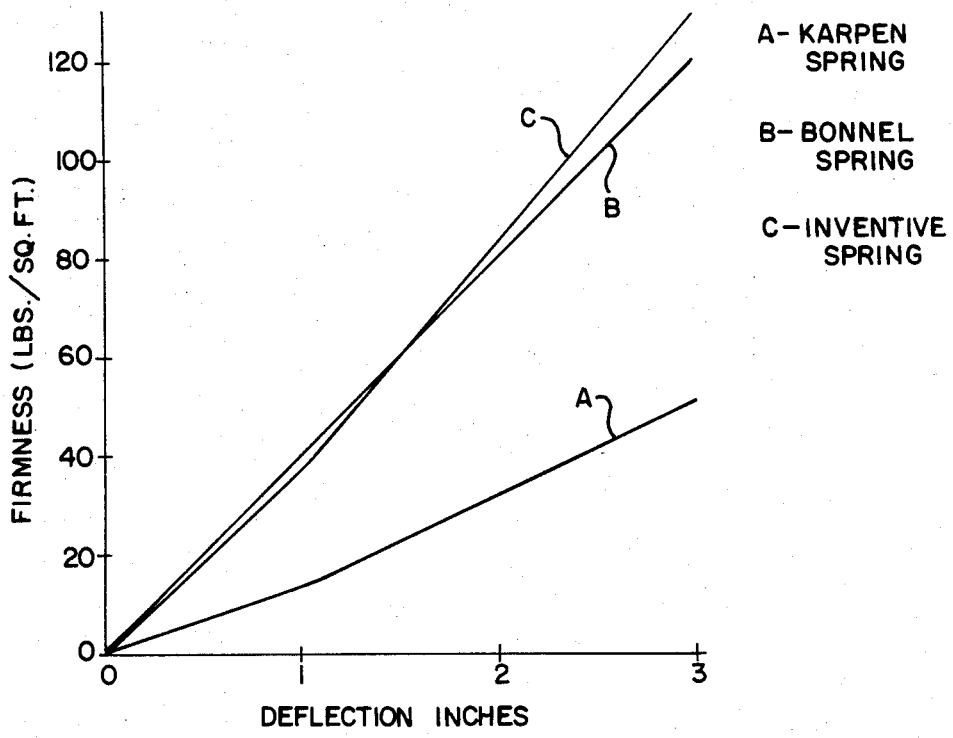
FIG. 9 is a graph of various springs under load.
Figures 10A, 10B, 11A, 11B, 12A, 12B:
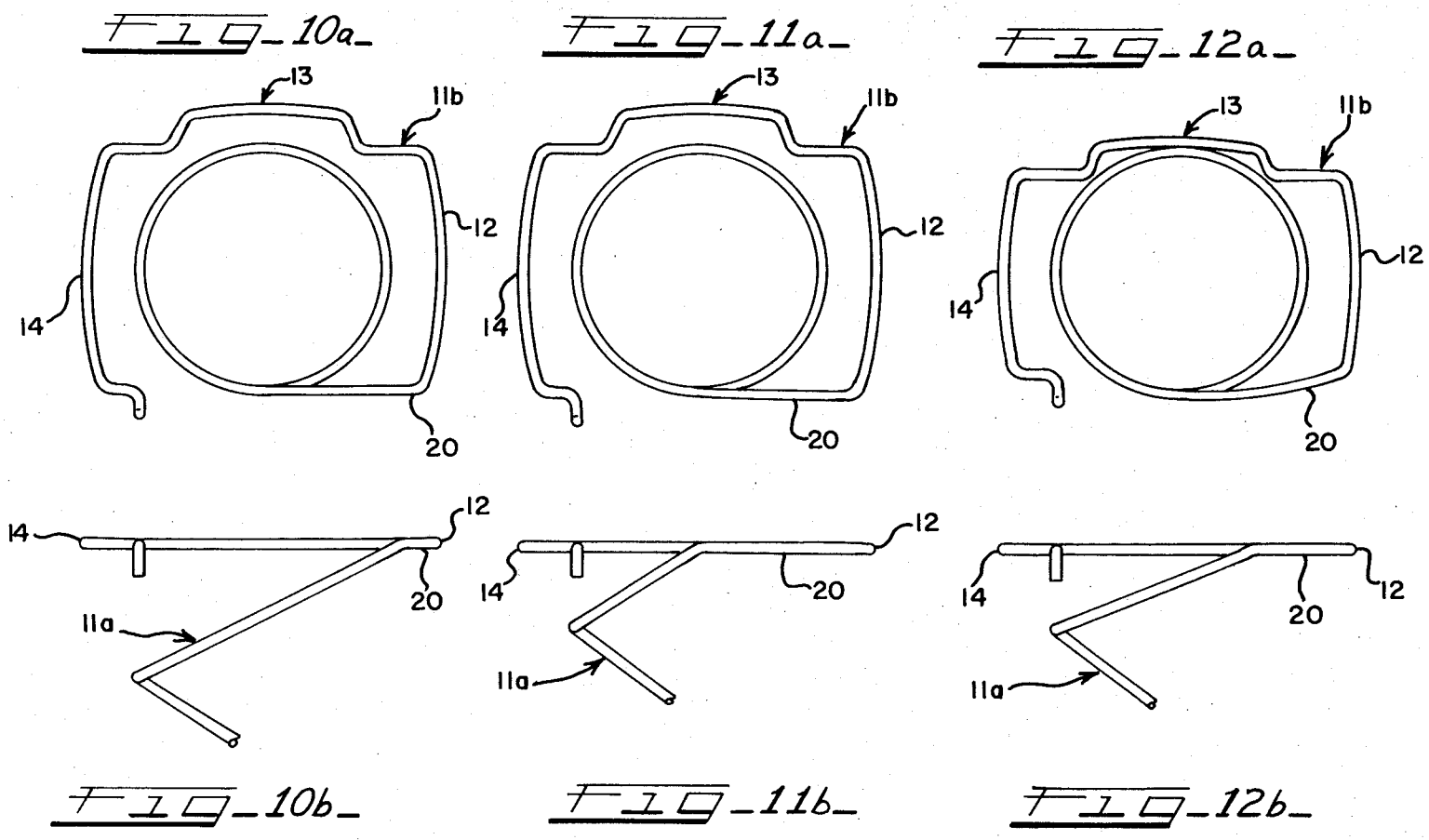
FIGS. 10*a*, 11*a* and 12*a* are plan views of terminal convolutions of three spring coils.
FIGS. 10*b*, 11*b* and 12*b* are elevational views of the respective terminal convolutions of FIGS. 10*a*, 11*a* and 12*a*.

The spring coil of this invention further provides a firmness that varies under load, i.e. as the coil is deflected. With reference to the graph of FIG. 9, an innerspring unit formed with springs of a Bonnell type exhibited a fairly linear deflection in response to an increasing load (line B). An innerspring unit formed of springs of the type shown in Karpen, U.S. Pat. No. 3,533,114 likewise exhibited a fairly linear response to load (line A).

An innerspring unit comprised of spring coils 11 of this invention exhibited a marked non-linear response to load (line C) in contrast to the foregoing innerspring units. The result is that in the initial stage of deflection, the innerspring assembly of this invention offers a first firmness that provides "surface comfort" to an individual. As increased load is imposed on the innerspring unit, the firmness increases to provide "depth" or "supportive" firmness. A more comfortable mattress is thereby produced.

Figure 3:
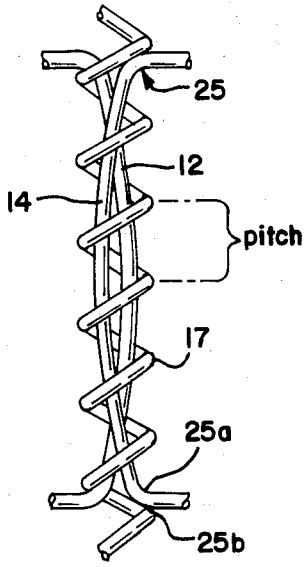
FIG. 3 is an enlarged plan view of a pair of overlapped offset portions encircled by a cross-helical as shown in FIG. 1.

Referring now to FIG. 3, another feature of this invention resides in matching the pitch of the cross-helicals 17 to the length of the offset portions 12, 14 to lock the coils 11 against rotation relative to one another. To this end, each of the offset portions 12, 14 has a shoulder 25 formed at each end thereof. An inside shoulder 25*a* and an outside shoulder 25*b* are thereby presented at each shoulder 25. The pitch (as indicated in FIG. 3) of the helical 17 is selected so that the cross-helical simultaneously engages the outside shoulders 25*b* of one of a pair of overlapped offset portions, such as the outside shoulders of offset portion 14 in FIG. 3. The offset portion 14, and thus its coil 11, is thereby firmly held against rotation by the cross-helical 17.

The pitch of the cross-helical 17 is also advantageously selected so that the cross-helical 17 catches the inside shoulders 25*a* of the other of the pair of overlapped offset portions. As shown in FIG. 3, the overlapped offset portions 12, 14 are coterminus, and the cross-helical 17 catches the inside shoulders 25a of offset portion 12. The coil 11 having the offset portion 12 is thereby further secured against rotation (it being understood that this same coil 11 will have its offset portion 14 held by the next adjacent cross-helical in the manner previously described).

Figure 4:
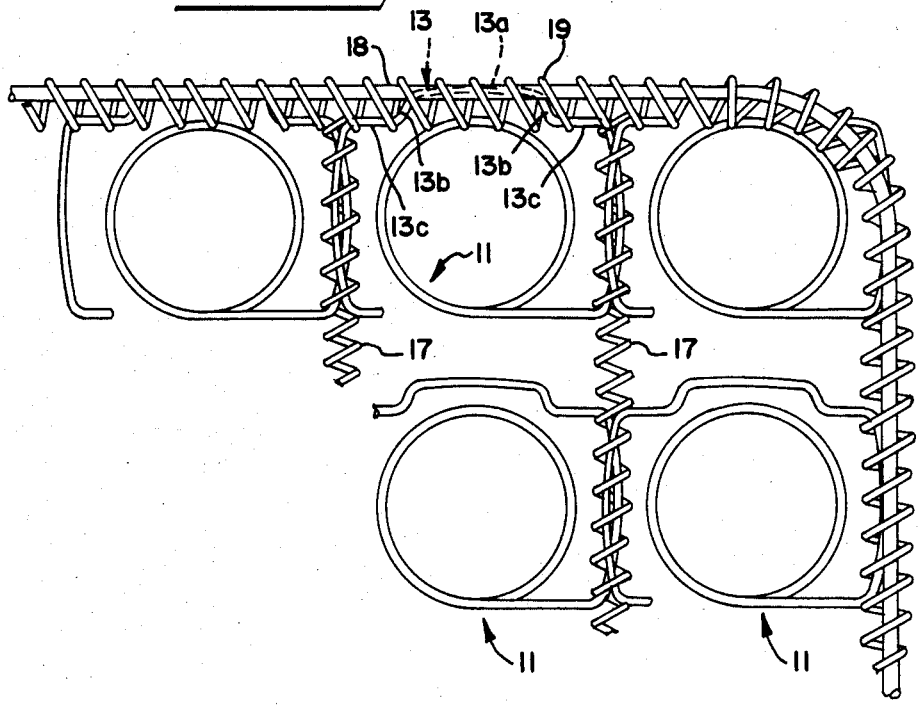
FIG. 4 is a view similar to FIG. 1 illustrating three point engagement of the third offset portion with the border wire.

Another feature of the invention relates to the three point attachment achieved between perimeter coils 11 and the border wire 18. Referring to FIGS. 2 and 4 in particular, third offset portion 13 has a stepped segment formed thereon comprised of a major straight part 13*a*, angled parts 13*b* extending from the ends of the major straight part 13*a*, and minor straight parts 13*c* extending from the angled parts 13*b*. The major straight part 13*a* is spaced radially outwardly from the coil body 11*a* and is generally tangential thereto. The minor parts 13*c* are approximately in line with each other and generally parallel to the major straight part 13*a*.

A border wire helical 19 is wrapped around the overlapped border wire 18 and third offset portion 13 to catch the inboard sides of the minor straight parts 13*c* and the outboard side of the major straight part 13*a*. This yields a three point attachment of the offset portion 13 with the border wire which is very secure, and which substantially prevents any hinging of the offset portion with the border wire.

Figure 5:
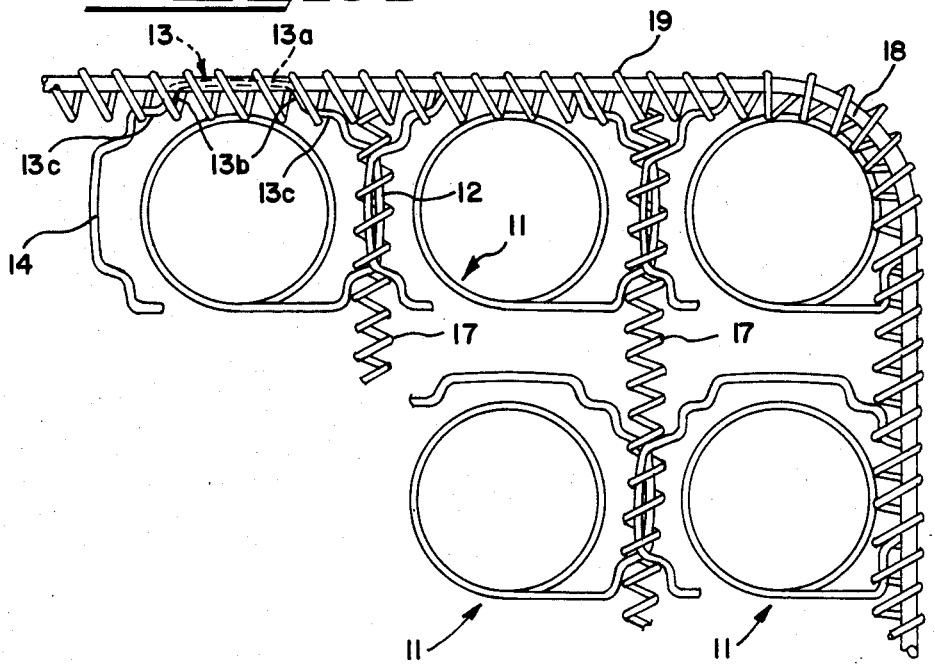
FIG. 5 is a view similar to FIG. 4 wherein the terminal convolutions of the spring coils have stepped segments on each offset portion.

As shown in FIG. 5, the terminal convolution of a coil 11 could be provided with such stepped segments on all three of its offset portions 12–14. Three point attachments of the perimeter coils would thus be effected around the entire border wire (although for full effect the last row of coils may have to be reversed so that the third offset portions thereof are adjacent the border wire).

Figure 6:
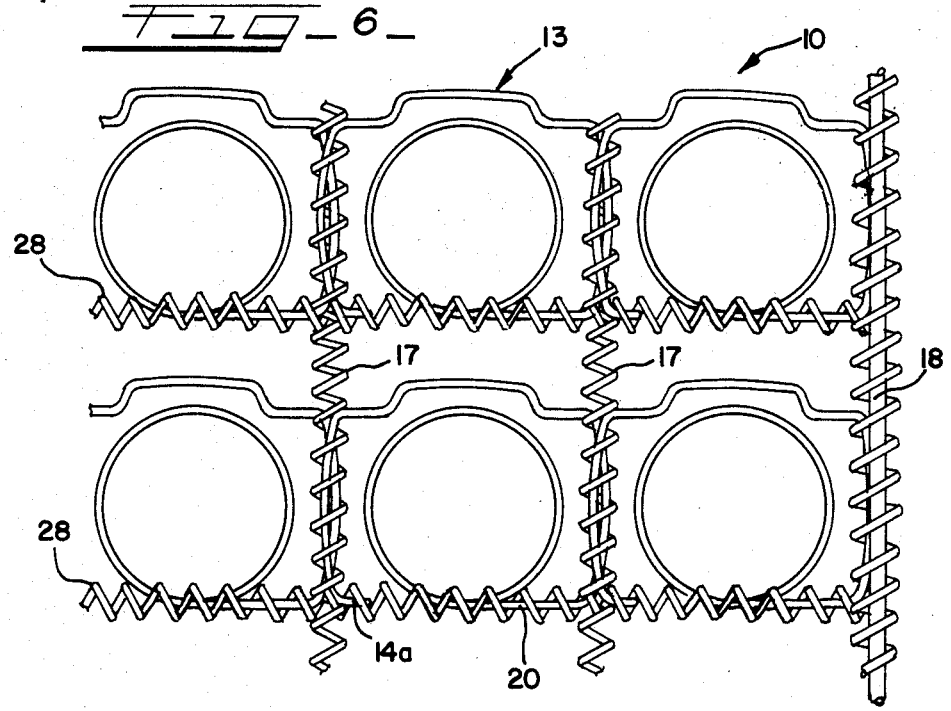
FIG. 6 is a plan view of a portion of the middle third a mattress innerspring unit showing orthogonally laced crosshelicals.

Another feature of the invention is the ability to adjust the firmness of the innerspring unit 10 through the addition of a second set of cross-helicals 28 which are orthogonal to the first set 17 to further interlace the coils. As seen in FIG. 6, the cross-helicals 28 extend along the coil rows, that is, they are across the width of the mattress. The cross-helicals 28 are substantially identical to the cross-helicals 17 and are wrapped about the short segments 14*a* and gradient arms 20 of the terminal convolutions. It will be noted that the cross-helicals 28 could alternatively be wrapped around the third offset portions 13 in a row to the same effect.

The second set of cross-helicals 28 provide extra firmness, and can extend along the entire length of one or both sides of the innerspring unit 10, or can be located in selected segments of the innerspring unit 10 to "posturize" the unit, such as the middle third of the innerspring. Such posturizing is readily accomplished due to arranging the springs so that the primary cross-helicals 17 run along the length of the mattress.

Figure 7:
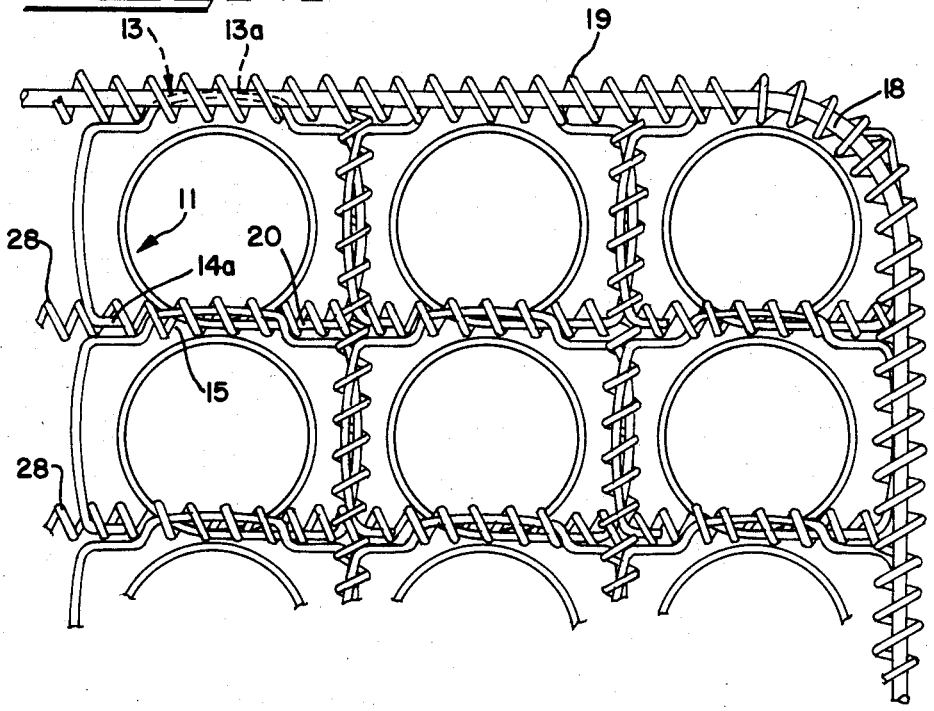
FIG. 7 is a view similar to FIG. 1 showing overlapped rows and orthogonally laced cross-helicals.

FIG. 7 illustrates yet another aspect of the invention whereby a very firm innerspring unit is produced. Adjacent rows of coils 11 are overlapped so that the third offset portions 13 of one row extend into the open ends 15 of the coils 11 of an adjacent row. A second set of cross-helicals 28 are then wrapped about the "overlapped" major straight portions 13*a* of one row and the short segments 14*a* and gradient arms 20 of the other row. A very dense pattern of coils 11 is thereby produced with virtually no gaps existing between coils 11.

Thus, while the invention has been described in connection with certain presently preferred embodiments, those skilled in the art will recognize modifications of structure, arrangement, portions, elements, materials and components which can be used in the practice of the invention without departing from the principles of this invention. For example, it will be understood that the features of this invention may be used separately or in combination, and are not to be viewed as restricted to application with the types of open end offset springs described herein unless so claimed.

What is claimed is:

1. A method for making a spiral spring coil having a firmness that is readily adjustable in manufacture for use in a mattress innerspring structure, comprising the steps of:

providing a spiral spring coil with a spiral coil body and a pair of terminal convolutions, at least one of said terminal convolutions having a free end, all portions of said at least one terminal convolution being in approximately the same plane, and forming a connecting segment between said terminal convolution and said spiral coil body in the form of a gradient arm extending in the same plane as the terminal convolution, said gradient arm being integrally connected with said spiral coil body at a shoulder, said gradient arm being adjustable in length in manufacture to vary the compression and thereby the firmness of the spring coil.

2. A method for making a spring coil for a mattress innerspring unit comprising the steps of:

forming a spiral spring coil body having two ends with a terminal convolution at each end of said spring coil body, forming at least one of said terminal convolutions into a C-shape with a first and a second offset portion which are opposed to each other, and a third offset portion joining said first and second offset portions, said first offset portion having a free end, all of said offset portions being approximately in the same plane, said second offset portion having one end joined to said third offset portion with the other end being joined to said spiral spring coil body by a connecting segment extending in the same plane as said terminal convolution, said connecting segment forming a gradient arm, which is integrally connected with said spiral coil body at a shoulder, and adjusting the length of said gradient arm in manufacture to vary the compression and thereby the firmness of the spring coil.

3. The spring coil of claim 2 wherein said first and second offset portions are generally straight segments that are parallel to each other, said connecting segment extending generally perpendicularly from said second offset portion.

4. The spring coil of claim 3 wherein both of said terminal convolutions are identical.

5. The spring coil of claim 4 wherein said connecting segment has a length which is in a range of about 3 to about 9% of the active material length of said spring coil.

6. A spring assembly for a generally rectangular mattress innerspring unit comprising:

a plurality of spring coils each having a spiral spring coil body with two ends, a terminal convolution at each end of said spring coil body, at least one of said terminal convolutions having a C-shape with a first and a second offset portion which are opposed to each other, and a third offset portion joining said first and second offset portions, said first offset portion having a free end, all of said offset portions being approximately in the same plane, said second offset portion having one end joined to said third offset portion with the other end being joined to said spiral spring coil body by a connecting segment extending in the same plane as said terminal convolution, said connecting segment forming a gradient arm that is adjustable in length in manufacture to vary the compression and thereby the firmness of the spring coil, said gradient arm being integrally connected with said spiral coil body at a shoulder, said spring coils being disposed on substantially parallel axes with said terminal convolutions on respective coil ends being generally co-planar and arranged in side by side relation in a plurality of parallel rows and parallel columns, first and second offset portions of adjacent spring coils overlapped with each other in said rows, a plurality of cross-helical springs extending along said columns and coiled about said overlapped first and second offset portions, a border wire surrounding a perimeter formed by said spring coils, and offset portions of spring coils at the ends of said rows and columns being joined to said border wire.

7. The spring assembly of claim 6 wherein said perimeter offset portions are joined to said border wire with a border wire helical spring coiled about said border wire and said perimeter offset portions.

8. The spring assembly of claim 7 wherein said third offset portions of said spring coils each have a stepped segment formed thereon, said stepped segment having a major part that is substantially straight and extending generally perpendicular to said first and second offset portions and spaced radially outwardly from said spring coil axis, short parts extending from the ends of said straight part, said short parts joining with remaining straight segments of said third offset portion which extend generally parallel to said straight part and which join with respective ends of said first and second offset portions, said border wire helical coiling around and closely embracing said straight part and said straight segments of said third offset portion to hold said third offset portion against rotation about said border wire.

9. The spring assembly of claim 6 wherein said first, second and third offset portions of said spring coils each have a stepped segment formed thereon, said stepped segment having a major part that is substantially straight and spaced radially outwardly from said spring coil axis, short parts extending from the ends of said straight part, said short parts joining with remaining straight segments of a respective offset portion which remaining straight segments extend generally parallel to said straight part, said border wire helical coiling around and closely embracing said straight part and said straight segments of perimeter offset portions to hold said perimeter offset portions against rotation about said border wire.

10. The spring assembly of claim 6 wherein said innerspring unit has a length and a width, said length being longer than said width, said spring coils arranged in rows extending across said width, said spring coil columns extending along said width, said spring coil columns extending along said length, and further including a second plurality of cross-helical springs extending along said rows and coiled about terminal convolution portions other than said first and second offset portions.

11. The spring assembly of claim 10 wherein said second plurality of cross-helical springs is concentrated in the middle third of said innerspring unit.

12. The spring assembly of claim 10 wherein said rows are immediately adjacent each other with said third offset portions of the springs in one row extending into the terminal convolutions of an adjacent row, said second plurality of cross-helicals being coiled about said connecting segments of one row and said third offset portions of an adjacent row.

13. The spring assembly of claim 12 wherein said first plurality of cross-helicals is orthogonal to said second plurality of cross-helicals, and said first and second pluralities of cross-helicals extend across the entire length and width of the innerspring unit.

14. A spring assembly for a mattress innerspring unit comprising:

a plurality of spiral spring coils, each spring coil having a body with two ends, a terminal convolution at each end of said spring coil body, at least one of said terminal convolutions having a first and a second offset portion which are on opposite sides of said spring coil body and parallel to each other, and a third offset portion joining said first and second offset portions, said first and second offset portions having a main segment that is generally straight, with said straight segment extending into a shoulder at each end thereof, each said shoulder having an inside and an outside, said spring coils being disposed on substantially parallel axes with said terminal convolutions on respective coil ends being generally co-planar and arranged in side by side relation in a plurality of parallel rows and parallel columns, first and second offset portions of adjacent spring coils being overlapped with each other in said rows, a plurality of cross-helical springs extending along said columns and coiled about said overlapped first and second offset portions, said cross-helical simultaneously engaging said outside shoulders of one of said overlapped offset portions to prevent rotation of said adjacent spring coils.

15. In a spring assembly formed of spring coils wherein each spring coil has its terminal convolution provided with offset portions terminating in shoulders with the offset portions of adjacent coils in a row overlapped, the improvement comprising:

encircling the overlapped portions with a crosshelical the internal diameter of which is slightly greater than the combined diameters of the overlapped portions and having a helical pitch which is matched to the distance between the outsides of said shoulders of at least one of said overlapped offset portions such that said cross-helical simultaneously engages and embraces said shoulder outsides of said at least one overlapped offset portion to prevent rotation of the spring coil so engaged.

16. The spring assembly of claim 14 wherein the cross-helical further simultaneously engages the inside shoulders of the other of said overlapped offset portions.

17. The spring assembly of claim 15 wherein the cross-helical further simultaneously engages inside shoulders of the other of said overlapped offset portions.

18. The spring assembly of claim 16 wherein the ends of said overlapped first and second offset portions are substantially coterminus.

19. A spring assembly for a generally rectangular mattress innerspring unit comprising:

a plurality of spring coils having a spiral spring coil body with two ends, a terminal convolution at each end of said spring coil body, at least one of said terminal convolutions having a first and a second offset portion which are opposed to each other, and a third offset portion joining said first and second offset portions, all of said offset portions being approximately in the same plane.

said third offset portion of each said spring coil having a stepped segment formed thereon, said stepped segment having a major part that is substantially straight and extending generally perpendicular to said first and second offset portions and spaced radially outwardly from said spring coil axis, short parts extending from the ends of said straight part, said short parts joining with remaining straight segments of said third offset portion which extend generally parallel to said staight part and which join with respective ends of said first and second offset portions, a border wire surrounding a perimeter formed by said spring coils, and a border wire helical coiling around and closely embracing said straight part and said straight segments of said third offset portion adjacent said border wire to hold said third offset portion against rotation about said border wire.

20. The spring assembly of claim 19 wherein said first, second and third offset portions of said spring coils each have a stepped segment formed thereon.

21. A spring coil for a mattress innerspring unit comprising:

a spring coil body with two ends, a terminal convolution at each end of said spring coil body, at least one of said terminal convolutions having an offset portion formed thereon, said offset portion having a stepped segment formed thereon, said stepped segment having an elongated major part that is substantially straight, an angled part extending away from said major part at each end of said major part, and minor elongated straight parts which are substantially in line and parallel to said major straight part extending outwardly from the angled parts, said offset portion thereby formed being adapted to be overlapped with a border wire surrounding a perimeter formed by a plurality of spring coils, such that a border wire helical can be coiled around said major and minor straight parts adjacent said border wire to hold said offset portion against rotation about said border wire.

* * * * *

UNITED STATES PATENT AND TRADEMARK OFFICE

CERTIFICATE OF CORRECTION

PATENT NO. : 4,726,572

DATED : February 23, 1988

INVENTOR(S) : Keith A. Flesher et al.

It is certified that error appears in the above-identified patent and that said Letters Patent is hereby corrected as shown below:

In column 4, line 12, please delete "crosshelicals" and substitute therefor --cross-helicals--.

In column 9, lines 41-42, please delete "said spring coil columns extending along said width".

In column 10, line 29, please delete "crosshelical" and substitute therefor --cross-helical--.

Signed and Sealed this

Twenty-ninth Day of August, 1989

*Attest:*

*Attesting Officer*

DONALD J. QUIGG

*Commissioner of Patents and Trademarks*